United States Patent [19]

Patton

[11] 3,948,378

[45] Apr. 6, 1976

[54] METERED PARKING STALL

[76] Inventor: Samuel E. Patton, 344 King George Ave., Roanoke, Va. 24016

[22] Filed: Mar. 4, 1975

[21] Appl. No.: 555,091

[52] U.S. Cl..... 194/1 R; 194/DIG. 21; 194/DIG. 22

[51] Int. Cl.[2]..... G07F 17/24

[58] Field of Search..... 194/1 A, 1 R, DIG. 21, 194/DIG. 22; 58/141, 142, 143

[56] References Cited

UNITED STATES PATENTS

| | | | |
|---|---|---|---|
| 2,015,607 | 9/1935 | LaDelphia Shinn | 194/DIG. 21 |
| 2,088,683 | 8/1937 | Babson | 194/DIG. 21 |
| 2,588,502 | 3/1952 | Dunn | 194/1 A X |
| 2,627,920 | 2/1953 | Barlow | 194/DIG. 22 |
| 2,805,498 | 9/1957 | Mosher et al. | 194/DIG. 22 |
| 2,883,780 | 4/1959 | Goodman | 194/DIG. 22 |
| 3,161,275 | 12/1964 | Sullivan | 194/DIG. 22 |

*Primary Examiner*—Robert B. Reeves
*Assistant Examiner*—Francis J. Bartuska
*Attorney, Agent, or Firm*—Stevens, Davis, Miller & Mosher

[57] ABSTRACT

A parking system in which a parking area for accommodation of a vehicle therein is closed at one end and has a parking meter at the other end. An elongated arm is pivotally connected to a post on which the parking meter is mounted. The elongated arm is movable between a position in which it extends transversely of the parking area a sufficient distance to block removal of a vehicle parked therein and another position in which the arm does not block removal of a vehicle in the parking area. Structure, actuated by a vehicle to be parked, is provided in the parking area. This structure simultaneously actuates the parking meter and moves the arm into a position into which it blocks removal of a vehicle parked in the parking area. Upon returning to his vehicle, the operator thereof need only insert a sufficient monetary amount in the parking meter whereupon the parking meter will deactuate the structure so that the arm thereby moves from its position in which it blocks removal of the parked vehicle to its position in which it does not block such removal so the parked vehible may be removed from the parking area. The structure actuated by the vehicle may be a bumper contacted and moved by the bumper of a vehicle to be parked or a plate which is contacted and moved by a wheel of a vehicle to be parked.

26 Claims, 15 Drawing Figures

FIG. 1
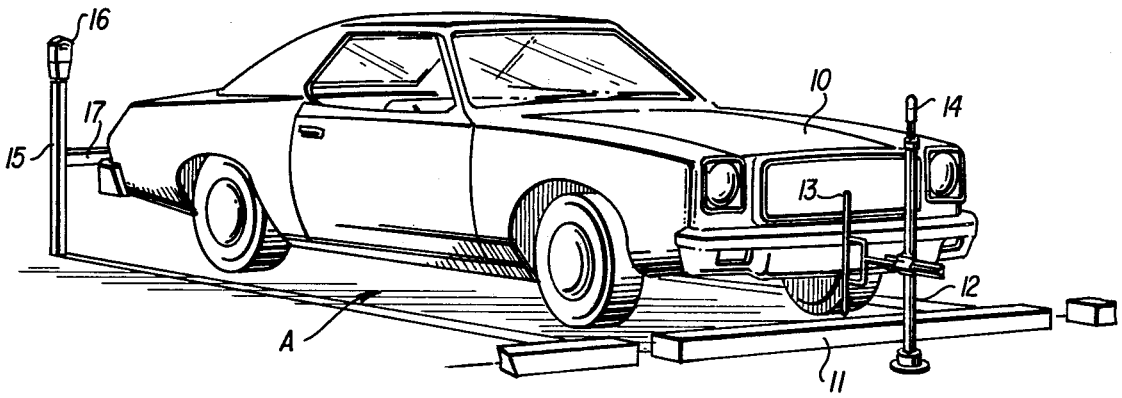
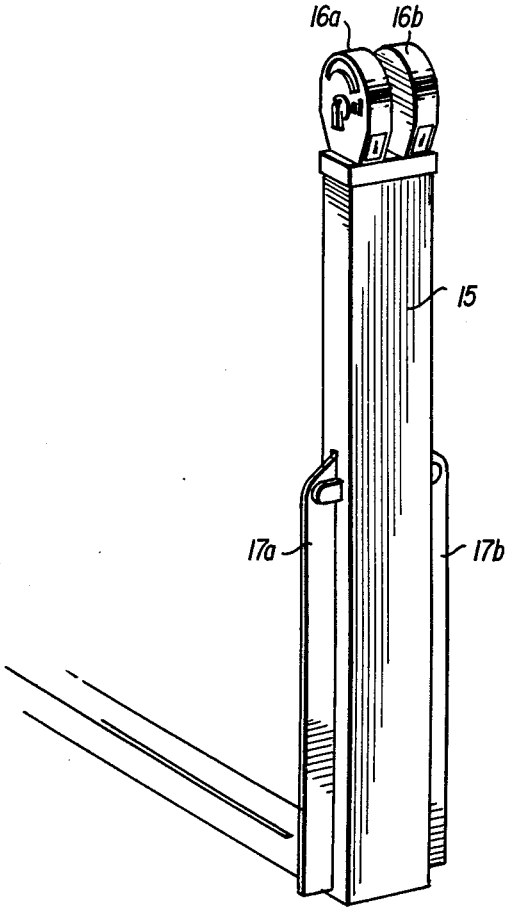
FIG. 14

FIG. 2
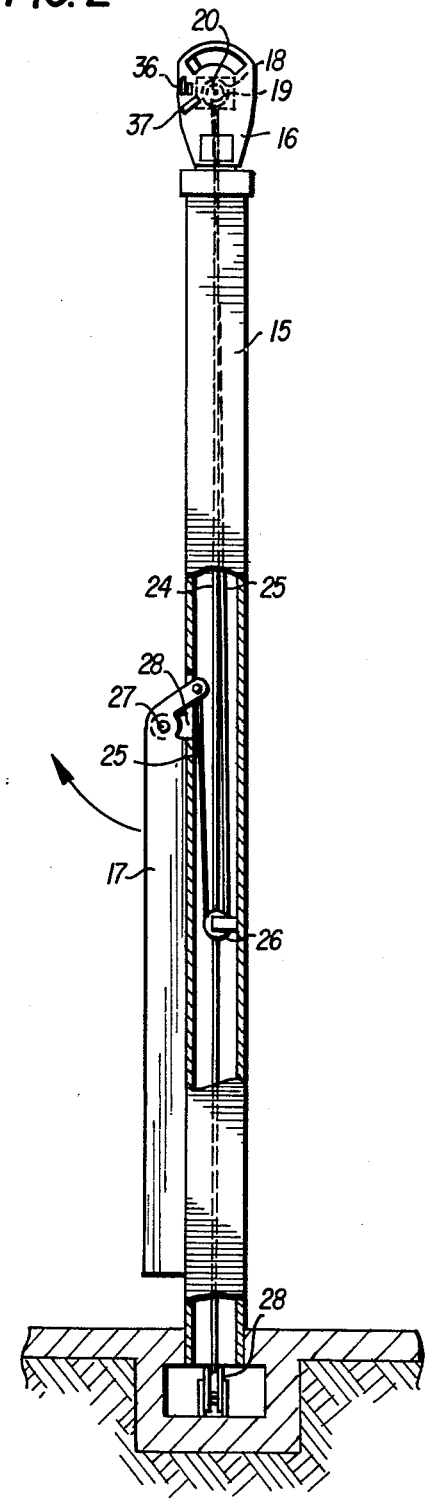
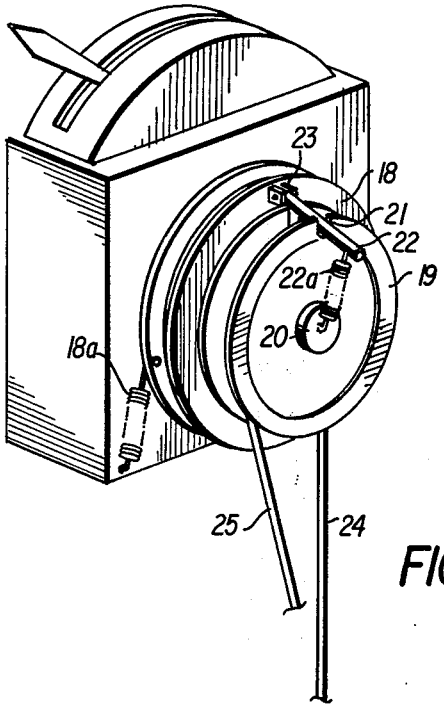
FIG. 3
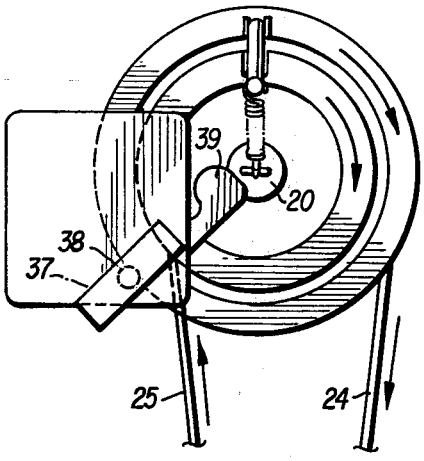
FIG. 4A
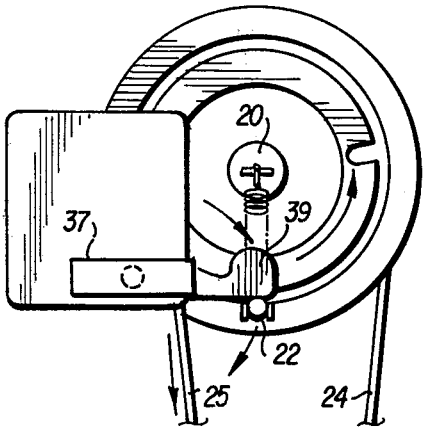
FIG. 4B

FIG. 12
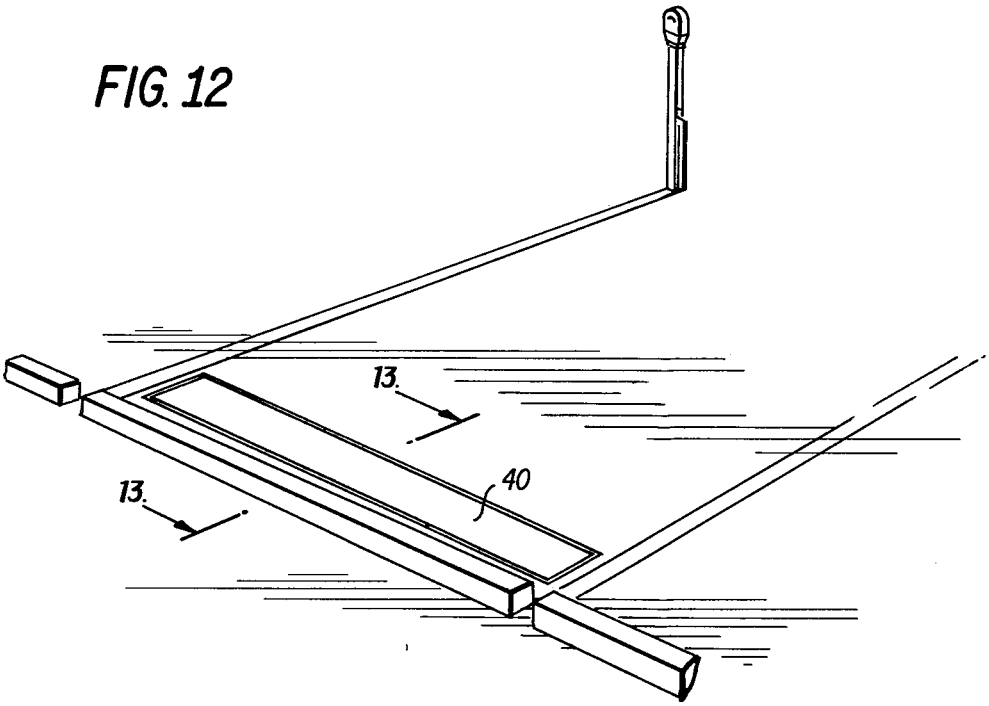
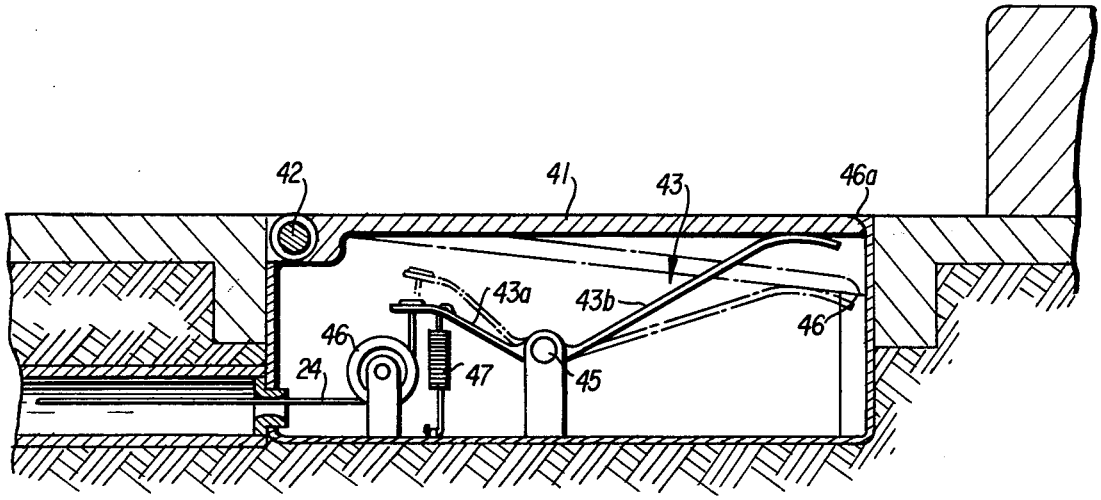
FIG. 13

METERED PARKING STALL

BACKGROUND OF THE INVENTION

1. Field of the Invention

This invention relates to a parking system for motor vehicles which is automatically actuated by the movement of the vehicle into parking position and is automatically deactuated by the insertion of a sufficient monetary amount in the parking meter and the removal of the parked vehicle from the parking area.

2. Description of the Prior Art

Various types of parking systems have been proposed. One of the most commonly known systems provides a parking meter in which the operator or occupant of a parked vehicle merely inserts a sufficient monetary amount into the parking meter at the time he initially parks therein. The amount of money he inserts in the meter is generally in proportion to the amount of time he anticipates the vehicle will be parked. This type of parking system is undesirable because it requires the motorist to anticipate the time during which his vehicle will remain parked. As a result, if the motorist incorrectly anticipates the time interval between his initial parking of the automobile and its subsequent removal, and if motorist either neglects or forgets to deposit further monetary amount into the meter, it is possible that he will receive a parking violation. This type of parking system has a further disadvantage in that it requires police supervision for potential violations. This supervision is necessary to discourage what could otherwise be free parking. This police supervision is costly and unnecessary.

A second type of parking system which is known utilizes a parking meter which is automatically operated, by movement of the vehicle into its parked position in the parking area, to measure the length of time the vehicle remains parked therein. Upon returning to the vehicle, the motorist deposits a sufficient monetary amount into the parking meter before removing the vehicle from the parking area. To assure payment of the proper payment corresponding to the parking period, this second type of parking system generally includes some form of barrier which is positioned behind one or both of the front wheels of a parked vehicle to prevent its removal from the parking area until such time as the sufficient monetary amount has been inserted in the parking meter. Examples of this second type of parking system are shown in U.S. Pat. No. 2,805,498 to R. E. Mosher et al, U.S. Pat. No. 3,503,480 to C. L. Shelby, Jr., and U.S. Pat. No. 3,757,916 to C. L. Shelby.

With the second type of system described above, since the vehicle is automatically blocked in the parking area and cannot be removed therefrom except by the insertion of a sufficient monetary amount in the parking meter, collection of the parking fee is assured and a supervisory attendant for the parking area is not required. This second type of parking system is satisfactory for both street curb parking and for off-street parking in lots and garages. Because this type of parking system is self-enforcing, less personnel are required to operate the parking system than are required for conventional parking lots and garages and, except for clean-up and maintenance, such personnel are not required at all.

SUMMARY OF THE INVENTION

This invention relates to a pparking system which is similar to the second type described above. The parking system of this invention includes a parking area for accommodation of a vehicle therein. One end of the parking area is obstructed to prevent movement from that end of a vehicle in the parking area. The invention further includes a parking meter and a barrier adjacent to the other end of the parking area. The barrier is movable between a first position in which it extends transversely of the parking area a sufficient distance to block removal of a vehicle parked therein and a second position in which the barrier does not block removal of the vehicle in the parking area. The invention further includes means, such as a plate adapted to be contacted and moved by a wheel of the vehicle or a bumper adapted to be contacted and moved by a bumper of the vehicle, which, when actuated by a vehicle to be parked, actuates the parking meter so that the parking time begins to run. Actuation also simultaneously moves the barrier from its position in which it does not block removal of a parked vehicle to the position in which it does block such removal. With the time running, the motorist may then leave his vehicle parked for any amount of time and does not have to be concerned about a parking violation.

Upon return to the vehicle, the motorist merely inserts the necessary monetary amount, which may correspond to the length of time the vehicle has been parked, in the parking meter. Upon the insertion of the necessary monetary amount in the parking meter, the parking meter deactuates the structure actuated by the vehicle upon initial parking so that the barrier thereby moves from its position in which it blocks removal of a vehicle in the parking area to its position in which it does not block such removal so that the parked vehicle may be removed from the parking area.

The parking meter is mounted at one end of the parking area on top of a post and the barrier is an elongated arm pivotally connected to the post.

The structure actuated by the vehicle may include a first pulley which is mounted on a shaft of a parking meter and a second pulley mounted on the shaft which is releasably connected to the first pulley.

An actuator member is provided which is adapted to be contacted and moved by a vehicle to be parked. The actuator member is disclosed in one embodiment as a bumper which is contacted and moved by a bumper of the vehicle to be parked and is disclosed in a further embodiment as a plate which is contacted and moved by a wheel of a vehicle to be parked. The structure actuable by the vehicle further includes two cables. The first cable has one end connected to the first pulley and the other end connected to the actuator member. The second cable has one end connected to the second pulley and the other end connected to the barrier so that when the structure actuated by the vehicle is initially acuated, the actuator member is moved by the vehicle and the first cable connected to the actuator member is also moved which thereby moves the first pulley as well as the second pulley releasably connected thereto and the barrier. The barrier is thereby moved from its position in which it does not block removal of the vehicle from the parking area into its position in which it does block such removal.

The two pulleys are releasably interconnected through the provision of a spring biased arm which is pivotally connected to the first pulley and releasably positionable in a notch or notches in the second pulley.

In the embodiment of the invention in which the actuator member is a bumper, the structure actuated by the vehicle includes a shaft rotatably mounted within a post, a third pulley rigidly connected to an end portion of the shaft, a pinion rigidly mounted on the shaft, and a rack in meshing engagement with the pinion. In this embodiment, the other end portion of the first cable is connected to the third pulley and the rack is rigidly connected to the bumper so that when the bumper is moved by a vehicle to be parked, the rack moves therewith and rotates the pinion, the shaft, and the third pulley, and thereby moves the first cable. This embodiment further includes a return spring which is connected between the post and the shaft which is adapted to return the bumper to its unactuated position when a parked vehicle moves out of contact therewith.

Also in this embodiment, an indicator member is provided which is connected to the upper end of the shaft. The indicator member is movable between a first lower position and a second upper position which indicates to the operator of the vehicle to be parked that it is properly parked. To effect the elevating movement of the indicator member, the upper end of the shaft is threaded. The indicator member is non-rotatable and is mounted over the upper end of the shaft. The indicator member includes a key which extends into the threads on the shaft so that when the bumper is moved by a vehicle to be parked, the rack rotates the pinion and the shaft and the key moves upwardly along the threads in the shaft and elevates the indicator member from its first lower position to its second upper position indicating to the vehicle operator that the vehicle is properly parked.

In the further embodiment of the invention, the actuator member is a treadle which is contacted and moved by a wheel of the vehicle to be parked. The treadle is a pivotable plate which extends transversely across the parking area for a distance preferably of at least ½ the width of the parking area. The plate lies substantially in the plane defined by the surface of the parking area and is movable between a first unactuated position and a second actuated position. In this embodiment, the structure actuated by the vehicle includes a two armed lever which is pivotable about an axis. One arm of the two arm lever is connected to the other end of the first cable and the other arm of the two arm lever is in abutment with the plate so that when the plate is contacted and moved by a wheel of a vehicle to be parked, the plate pivots and moves from its first unactuated to its second actuated position and moves the other arm and the one arm of the two arm lever therewith which thereby moves the other end of the first cable.

From the foregoing, it is apparent that this invention has as one of its principal objects, the provision of a parking system which is automatically operated by the movement of the vehicle into parked position in the parking area. This object is accomplished in part by the provision of structure actuated by the vehicle which initiates timing of the parking meter and moves a barrier, at one end of the parking area, into a position in which it blocks removal of the vehicle from the parking area.

A further object of this invention is to provide structure, in the form of a plate contacted and moved by a wheel of a vehicle to be parked which actuates the parking meter and moves the barrier from a position in which it does not block removal of a vehicle from the parking area into a position into which it does block such removal.

A further object of this invention is to provide structure, in the form of a bumper, which is adapted to be contacted and moved by a bumper of the vehicle, which, when actuated by the vehicle to be parked, actuates the parking meter and moves the barrier from its position in which it does not block removal of a vehicle to be parked into a position into which it does block such removal.

A further object of this invention is to provide a superior parking system which is self-enforcing.

A further object of this invention is to provide a superior parking system in which a vehicle occupant only pays for the time the vehicle is actually parked.

A further object of this invention is to provide a superior parking system in which a parked vehicle cannot be removed from the parking area until a sufficient monetary amount has been inserted into the parking meter.

A further object of this invention is to provide a superior parking system in which the vehicle occupant does not have to insert any money into the parking meter until he is ready to leave the parking area.

A further object of this invention is to provide a superior parking system which indicates to the occupants of the vehicle that the vehicle is properly parked in the parking area.

BRIEF DESCRIPTION OF THE DRAWINGS

FIG. 1 is a perspective view of a first embodiment of the invention showing a vehicle parked in a parking area;

FIG. 2 is a side view of the parking meter, the post on which it is mounted, and the barrier;

FIG. 3 is a detailed perspective view of the parking meter and a portion of the structure actuated by the vehicle;

FIG. 4A is an end view of a portion of the structure actuated by the vehicle in its unactuated position;

FIG. 4B is a view similaar to FIG. 4A but showing the same in a position in which the parking meter has been satisfied by a sufficient monetary amount so that the structure actuated by the vehicle is returning to its unactuated position;

FIG. 12 is a perspective view of a second embodiment of the invention;

FIG. 13 is a section view along line 13—13 of FIG. 12; and

FIG. 14 is a perspective view of a single post having two parking meters thereon and two barriers connected thereto.

DESCRIPTION OF THE PREFERRED EMBODIMENTS

Figure 5:
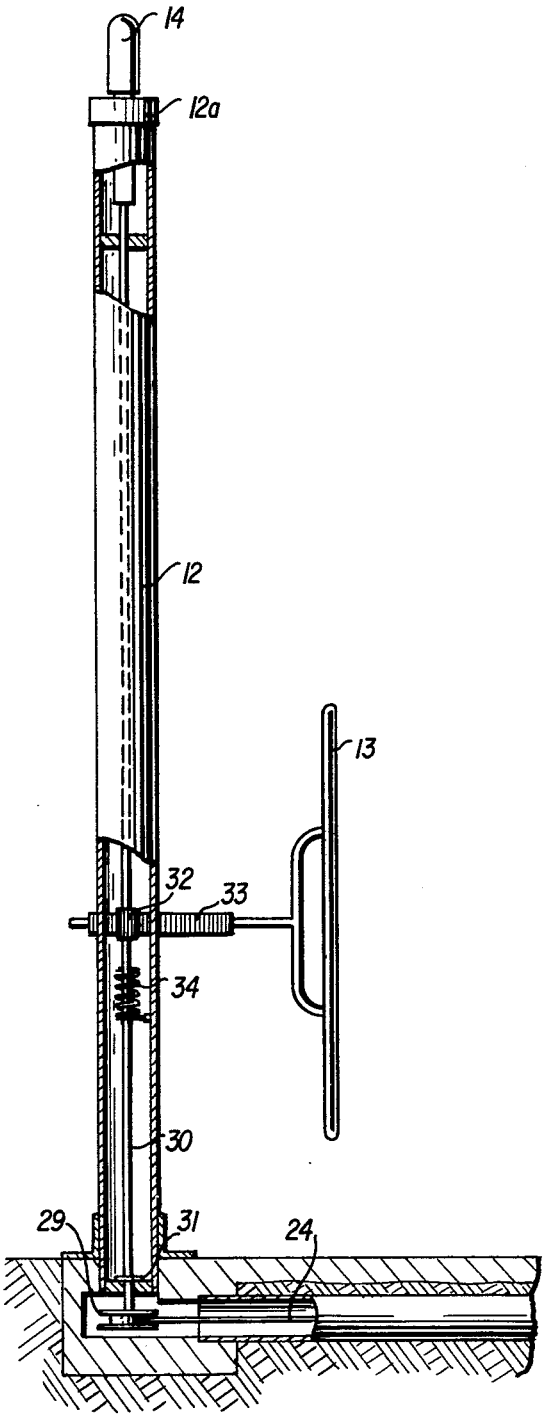
FIG. 5 is a side view of the structure actuated by the vehicle.
Figure 7:
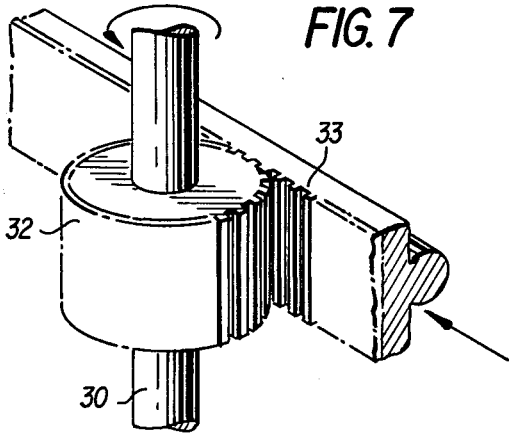
FIG. 7 is an enlarged view of the rack and pinion shown in FIG. 5.

With reference to FIG. 1, there is shown therein an automobile 10 parked in a parking area A. At one end of the parking area is positioned a curb 11 and a post 12 which extends upwardly from the ground. The curb 11 and post 12 obstruct the movement of a parked vehicle from that end of the parking area A. A bumper 13 is connected to the post 12. The bumper 13 is adapted to be contacted and moved by the bumper of the vehicle to be parked in a manner to be subsequently described. At the upper end of the post 12 is an indicator member 14 which, as shown in its uppermost position in FIG. 1, indicates to the occupant of the vehicle 10 that the vehicle is properly parked.

At the other end of the parking area A is positioned a post 15. A parking meter 16 is positioned on the upper end of the post 15. A barrier, in the form of an elongated arm 17, is pivotally connected to the post 15. The barrier 17 is movable between a position in which it blocks removal of the vehicle 10 from the parking area A and a position in which it permits such removal.

With reference to FIGS. 2 and 3, a first pulley 18 and a second pulley 19 are shown. Each of the pulleys 18 and 19 are freely rotatably mounted on a shaft 20 which extends from a portion of the parking meter 16. With particular reference to FIG. 3, the releasable interconnection between the pulleys 18 and 19 will be described. A notch 21 is cut in each of the annular flanges of the second pulley 19. Releasably positionable in the notch 21 is an elongated arm 22 pivotally connected at 23 to the periphery of the first pulley 18. A spring **22*a* has one end connected to an end of the arm 22 and its other end connected to the end of the shaft 20. The spring 22*a* functions to hold the arm 22 in the notch 21 of the second pulley 19 so that the pulleys 18 and 19 are thereby releasably interconnected so as to be rotatable together about the axis of the shaft 20. A return spring 18*a* is connected between the parking meter 16 and the periphery of the first pulley 18. The return spring 18*a* functions to return the pulley 18 to its initial position shown in FIG. 3** upon deactuation of the parking system.

A first cable 24 and a second cable 25 are also shown in FIGS. 2 and 3. With particular reference to FIG. 3, one end of the first cable 24 is connected to the first pulley 18 and one end of the second cable 25 is connected to the second pulley 19. As shown in FIG. 2, the second cable 25 extends downwardly from the second pulley 19 and extends partially around a freely rotatable pulley 26 and then continues upwardly within the post 15 for connection at its other end to one end portion of the barrier 17. As shown in FIG. 2, the barrier 17 is pivotally connected at 27 to an outwardly extending lug 28 on the post 15. As will subsequently appear, when the second pulley 19 rotates in a counterclockwise direction as shown in FIGS. 3 and 4B, the second cable 25 is wound thereon so that the portion thereof connected to the arm 17 is moved downwardly which thereby pivots the arm 17 about the axis 27 and moves the arm 17 from its downwardly extending position in which it does not obstruct removal of the vehicle from the parking are A to its outwardly extending position as shown in FIG. 1 in which the arm 17 does block such removal.

The first cable 24 extends downwardly within the post 15 from its connection to the first pulley 18 and into the ground where it extends partially around a freely rotatable pulley 28 (FIG. 2). From the pulley 28, the first cable 25 extends, within a conduit buried in the ground, longitudinally along the parking area A beneath the surface thereof. The first cable 25 terminates at its other end where it is connected to a pulley 29. The pulley 29 is rigidly connected to the lower end of a shaft 30 freely rotatably mounted in a plurality of bearings connected to the post 12. At least one locking lug 31 is rigidly connected to the shaft 30 to prevent the shaft from moving axially downwardly relative to the post 12.

Figure 9:
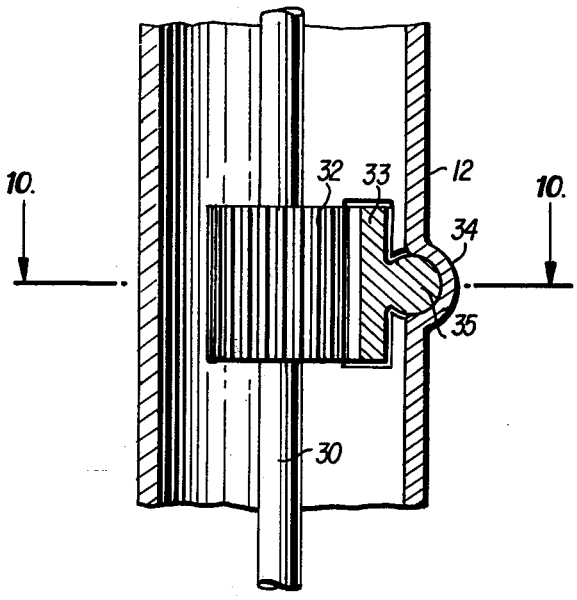
FIG. 9 is a sectional view showing the rack and pinion, shaft and post of FIG. 5.
Figure 10:
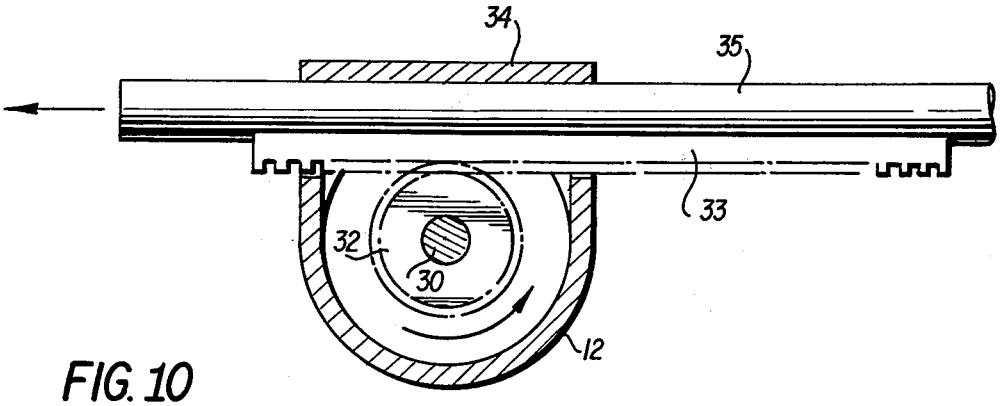
FIG. 10 is a section view along line 10—10 of FIG. 9.

As shown in FIGS. 5, 7, 9 and 10, a pinion 32 is rigidly connected to the post 30. Extending through the post 30 is a rack 33 which is adapted to mesh with the pinion 32 on the shaft 30. The rack 33 is guided for movement through the post 12, as shown in FIG. 9, by the provision of a guideway 34, in the form of a groove. The rack 33 has an axially extending projection 35 thereon which rides and is guided by the guideway 34 of the post 12. Upon movement of the rack 33 to the left as shown in FIG. 10, the pinion 32 and shaft 30 rotate in a counterclockwise direction. Likewise, clockwise movement of the pinion 32 and shaft 30 moves the rack 33 toward the right as viewed in FIG. 10.

The bumper 13 is rigidly connected to the rack 33. Therefore the movement of the rack 33 to the left, as shown in FIG. 5, is caused by the bumper 13 being contacted and moved by the vehicle 10 to be parked.

Figure 6:
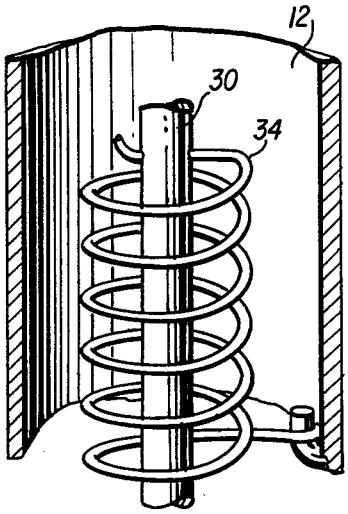
FIG. 6 is an enlarged view of the return spring shown in FIG. 5.

As shown in FIGS. 5 and 6, a return spring 34 is positioned around the shaft 30. One end of the coil spring 34 is fixedly connected to the shaft 30 and the other end thereof is fixedly connected to the post 12. As will subsequently appear, the return spring 34 functions to return the bumper 13, rack 33, pinion 32, and shaft 30 to their original unactuated position when the vehicle 10 is removed from the parking area.

Figure 11:
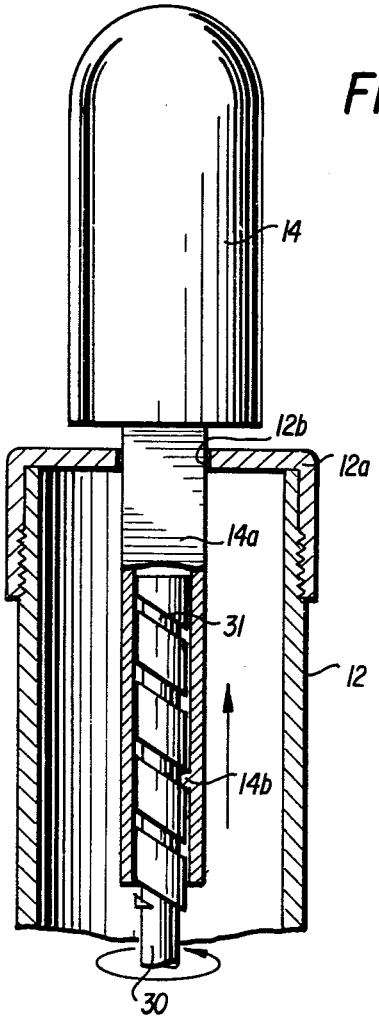
FIG. 11 is a view on an enlarged scale, partly in section, of the upper end of FIG. 5 showing the threaded end of the shaft as well as the indicator member.

As shown in FIGS. 1, 5 and 11, the indicator member 14 is mounted over the upper end of the shaft 30. The indicator member 14 is movable between a lower position, as shown in FIGS. 5 and 11, and an upper position, as shown in FIG. 1. The upper position is intended to indicate to an occupant or driver of the vehicle when parked that the vehicle has been properly parked. As will subsequently appear, the indicator member 14 moves from its lower position to its upper position upon rotation of the shaft 30 when the bumper 13 has been actuated. As shown in FIG. 11, the upper end of the post 12 is closed by a cap **12*a*. The cap 12*a* has a central aperture 12*b* defined therein. The aperture 12*b* is non-circular in cross-section and is preferably either square or rectangular in cross-section. The lower end 14*a* of the indicator member 14 is shaped in cross-section substantially identical to the cross-section of the aperture 12b but is of slightly smaller overall dimensions so that the lower end of the indicator member 14 can be freely positioned through the aperture 12b and over the upper end of the shaft 30**.

As shown particularly in FIG. 11, the upper end of the shaft 30 is provided with a plurality of threads 31 wound thereabout. The interior of the lower end of the indicator member 14 is hollow so that the threaded portion of the shaft 30 may be positioned therein. Extending inwardly from the lower end **14*a* of the indicator member 14 is at least one projection or key 14*b* which is positionable in the threads of the upper end of the shaft 30. Therefore, upon rotation of the shaft 30 in the direction shown by the arrow in FIG. 11, the key 14***b* on the lower portion 14*a* of the indicator member 14 rides upwardly along the threads in the upper end of the shaft 30 to thereby move the indicator member 14 upwardly into the position into which it indicates to an occupant or driver of the vehicle 10 that the vehicle has been properly parked.

It is contemplated in this invention that a sign could be positioned adjacent to the indicator member 14. The sign may have a mark, such as line, thereon which corresponds to the upper position of the indicator member 14. The sign may carry a statement which in effect tells an occupant of the vehicle that it is properly parked when the indicator member is at the level of the mark.

A brief description of the operation of the pulleys 18 and 19 will now be described. When the bumper 13 is contacted and moved by the bumper of the vehicle 10 to be parked, the cable 24 is moved downwardly as shown in FIG. 4A. Therefore, by reason of the connection of the end of the first cable 24 to the pulley 18, the pulley 18 rotates in a clockwise direction about the axis of the shaft 20. By reason of the interconnection of the pulleys 18 and 19, the pulley 19 is likewise rotated in a clockwise direction as shown in FIG. 4A. This clockwise rotation is through substantially 180°. Upon rotation of the second pulley 19 in a clockwise direction, the cable 25 connected thereto is moved upwardly so that the portion connected to the arm 17 moves downwardly. Therefore, the downward movement of the arm 17 at its connection to the cable 25 effects an upwardly pivoting movement of the barrier or arm 17 about the axis 27 and thereby moves that arm into its position in which it extends transversely across the end of the parking area where it blocks removal of the vehicle 10 from the parking area A.

Figure 8:
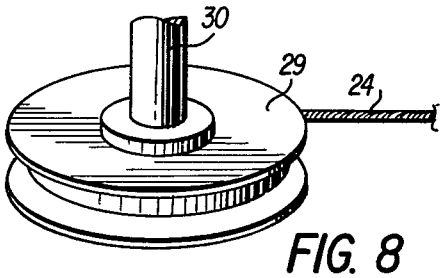
FIG. 8 is an enlarged view of the pulley and cable connected thereto shown in FIG. 5.

The details of the parking meter 16 will not be described here. Rather only the essential elements thereof necessary for an understanding of this invention will be described. Such parking meters are known per se and are described and shown in various U.S. patents which include U.S. Pat. Nos. 1,799,056, 2,070,445, 3,503,480, 3,757,916, and 2,805,489. Suffice it to say that a mechanical or electrical switch can be provided between the parking meter 16 and the first pulley 18. Upon initial clockwise rotation of the pulley 18, the switch is actuated to start the timer on the parking meter 16. Furthermore, after parking a sufficient monetary amount must be inserted into the parking meter 16 through the slots 36. Upon insertion of the necessary amount, the handle 37 on parking meter 16 is permitted to rotate clockwise about the axis of a pin 38 from its position shown in FIG. 4A to its position shown in FIG. 4B. Rotation of the handle 37 likewise effects rotation of a hammer 39 connected thereto. Upon rotation, hammer 39 deactuates the timer and returns the timer switch to its deactuated or off position. Upon rotation, as shown in FIG. 4B, the hammer 39 also strikes the free end of the arm 22 and moves it out of the notch 21 in the pulley 19. With the arm 22 out of the notch 21, the weight of the arm 17 outwardly of the pivot axis 27 causes arm 17 to fall to its downwardly extending position. As the arm 17 falls, it pulls the portion of the cable 25 connected thereto upwardly and pulls the portion of cable 25 adjacent the pulley 19 downwardly and thereby rotates the pulley 19 in a counterclockwise direction as shown in FIG. 4B so that pulley 19 thereby returns to its initial position as shown in FIG. 3. With the arm or barrier 17 in its lower position in which it does not block removal of the vehicle from the parking area, the motorist can remove the vehicle from the parkking area. Upon such removal, the bumper 13, rack 33, pinion 32, shaft 30, and indicator member 14 are returned to their initial position by reason of the action of the return spring 34 returning the shaft 30 to its initial state. Upon this returning movement, the end of the cable 24 connected to the pulley 29 is free to move toward the right as shown in FIGS. 5 and 8. By reasons of the return spring 18*a* connected to pulley 18, the first pulley 18 returns to its initial FIG. 3 position and the portion of the cable 24 adjacent the first pulley 18 is moved upwardly and partially wound about the pulley 18. Upon return of first pulley 18 to its initial position, the arm 22 moving therewith, when it reaches the uppermost position shown in FIG. 3, falls back into the notches 21 on the periphery of the second pulley 19 by reason of the biasing action of the spring 22*a*.

The operation of the above described embodiment of the invention will now be fully described. Initially, the barrier or arm 17 is in its lowermost downwardly extending position, as shown in FIG. 2, in which it does not block entry or removal of a vehicle into or out of the parking area A. When a vehicle to be parked enters the parking area A, the bumper of the vehicle contacts and moves the bumper 13 as shown in FIG. 1. This movement of the bumper 13 is toward the left, as shown in FIG. 5, and moves the rack 33 to the left. Movement of the rack 33 rotates the pinion 32 and shaft 30 in the direction shown by the arrow in FIG. 7. This movement effects a winding of the return spring 34. As described above, and as shown in FIG. 11, this rotation of the shaft 30 in the direction shown by the arrow in FIG. 11, causes the indicator member 14 to move from its lower position shown in FIGS. 5 and 11, to its upper position as shown in FIG. 1. As noted above, the upper position indicates to the occupant or driver of the parked vehicle that the vehicle is properly parked. This upward movement of the indicator member 14 is effected by the upward movement of the key 14*b* on the lower portion 14*a* of the indicator member 14 in the threaded portion of the upper end of the shaft 30. The indicator member 14 is prevented from rotating with the shaft 30 by reason of the non-circular cross-section of the lower portion 14*a* of the indicator member 14 together with the similar cross-section of the aperture 12*b* in the cap 12*a* on top of the post 12.

The rotation of the shaft 30 effects a partial winding of the first cable 24 around the pulley 29 connected to the lower end of the shaft 30. This causes a movement of the cable 24 toward the left as shown in FIGS. 5 and 8. As noted above, the cable 24 is turned partially around the freely turning pulley 28 and continues upwardly to its connection to the first pulley 18. The movement of the cable 24 toward the left as shown in FIGS. 5 and 8 effects a downward movement of the portion of the cable 24 adjacent to and connected to the first pulley 18. This downward movement causes a clockwise rotation of substantially 180° of the first pulley 18 connected therewith and stretches the return spring 18*a*. Furthermore, the second pulley 19, by reason of its being releasably connected with the first pulley 18 through the arm 22 engaged in the notch 21, causes a similar substantially 180° clockwise rotation of the second pulley 19. This rotation of the pulley 19 causes a partial winding of the cable 25 around the second pulley 19 which thus moves the portion of the cable 25 adjacent the second pulley 19 upwardly. As noted above, the second pulley 25 is mounted around a freely rotatable cable 26 and extends upwardly therefrom to its connection to one end of the arm 17. Therefore, the upward movement of the portion of cable 25 adjacent pulley 19 causes a downward movement of the portion of cable 25 adjacent arm 17. With reference to FIG. 2, this downward movement of the portion of the cable 25 connected to and adjacent the barrier of arm 17 effects an upward pivoting movement of the arm 17 about the pivot axis 27 so that the arm 17 is thereby moved from its lower position in which it does not block removal of a vehicle from the parking area A into its upwardly outwardly substantially horizontally extending position shown in FIG. 1 in which the arm or barrier 17 blocks removal of the vehicle 10 from the parking area A. The vehicle 10 cannot now be removed from the parking area A without satisfying the parking meter 16. The initial clockwise rotation of the first pulley 18 initially actuates the mechanical or electrical switch between the pulley 18 and meter 16 to start the meter running.

Upon return of the occupant of the vehicle 10 to the parking area A, he must first insert sufficient coins into the parking meter 16 before the barrier 17 will be moved to its lower position so that he may exit from the parking area A. As described above, upon insertion of a sufficient monetary amount in the parking meter 16 through the coin slots 36, the handle 37 is permitted to rotate about the axis 38 to thereby rotate the hammer 39 from its FIG. 4A position to its FIG. 4B position at which point it contacts and moves the arm 22 out of the notch 21 so that the second pulley 19 is then again freely rotatable about the axis of the shaft 20. The movement of hammer 39 likewise deactuates the timer and returns the timer switch to its initial off position. With the arm 22 free of the notch 21, the weight of the arm 17 outwardly of the pivot axis 27 causes the arm 17 to pivot downwardly about that axis so that the end thereof which is connected to the cable 25 moves upwardly and likewise moves that portion of the cable 25 upwardly. The movement of the portion of the cable 25 adjacent the arm 17 upwardly effects a similar downward movement of the portion 25 of the cable which is connected to the second pulley 19 so that the pulley 19 is rotated through substantially 180° in a counterclockwise direction back to its initial position shown in FIG. 3.

With the barrier or arm 17 in its lower position in which it does not block removal of the vehicle 10 from the parking area A, the operator may then remove the parked vehicle from the parking area. Upon removal of the parked vehicle 10 from the paring area A, the vehicle bumper, moves away from the bumper 13. Therefore, the return spring 34 which was wound upon actuation of the bumper 13, rotates the shaft 30 and pinion 32 in a direction opposite that shown by the arrow in FIG. 7. This rotation of the pinion 32 effects a movement of the rack 33 and bumper 13 to the right as shown in FIG. 5 and returns them to their initial unactuated position. Likewise, as described and as shown in FIG. 11, the rotation of the shaft 30 in a direction counter to that shown in FIG. 11, causes the key **14*b* on the lower portion 14*a* of the indicator member 14 to move downwardly along the threads on the upper end of the shaft 30 and thereby moves the indicator from its upper position back to its lower initial position. This movement takes some of the tension out of the cable 24 and frees it for movement to the right as viewed in FIG. 5 so that the tension of the expanded return spring 18*a* connected between the parking meter and the first pulley 18 returns the pulley 18 from its position shown in FIG. 4B back to its original position shown in FIG. 3.** The parking system has then completed one complete cycle of operations and is ready for another vehicle to be parked therein.

A second embodiment of the invention is shown in FIGS. 12 and 13. This embodiment is similar to the embodiment described above but differs therefrom in the type of structure actuated by the vehicle. In this embodiment, the vehicle to be parked actuates a treadle 40. The treadle 40 comprises a plate 41 which is pivotally connected about an axis 42 for movement between the initial unactuated position, which is shown in solid lines in FIG. 13, and a second actuated position, as shown in dotted lines in FIG. 13. The plate 41 lies substantially in the plane defined by the surface of the parking area A.

Advantageously, the plate 41 extends transversely across the parking area for a distance of at least one half the width of the parking area so that it is virtually impossible for any vehicle to park therein without having one of the front wheels of that vehicle coming into contact with and moving the plate 41 from its unactuated position to its actuated position. Therefore, it is almost impossible for the vehicle to enter into the space without properly actuating the parking system.

In this second embodiment, the end of the cable 24 is connected to one arm **43*a* of a two arm lever 43 which is pivotable about an axis 45. A return spring 47 is connected between the arm 43*a* and the bottom of a casing in which the treadle 14 is positioned. As shown in FIG. 13, the other arm 43*b* of the two arm lever 43 is in abutment with the lower side of the plate 41. The downward movement of the plate 41 into its actuated position is limited by a stop 46 and the upward movement of the plate 41 into its deactuated position is limited by a stop 46*a*. The other end of the cable 24 is connected, as in the first embodiment described above, to the first pulley 18.**

Except for the difference in the structure which is actuated by the vehicle, this second embodiment operates substantially identical to the first embodiment. Therefore, a detailed description of that operation will not be given here. Briefly, this second embodiment operates as follows. When a vehicle to be parked enters the parking area, the front wheels thereof come into contact with the plate 41 and, by reason of the weight of the vehicle, pivot the plate 41 about the pivot axis 42 so that the plate moves into its lower actuated position shown in dotted lines in FIG. 13. This downward movement of the plate 41, causes a pivotal movement of the arm **43*b* of the two arm lever 43 about the axis 45 in a clockwise direction which likewise pivots the arm 43*a* of the two arm lever 43 upwardly in a clockwise direction as shown in FIG. 13. This effects an upward movement of the portion of the cable 24 adjacent the arm 43*a* which through the freely rotatable pulley 46 effects a movement of the horizontally extending portion of the cable 24 shown in FIG. 13 to the right. This movement of the cable 24 translates into a downward movement of the portion of the cable 24 adjacent and connected to the first pulley 18 as in the first embodiment. Therefore, as in the embodiment described above, the pulley 18 rotates clockwise into the position shown in FIG. 4B and the pulley 19, by reason of its releasable interconnection with the pulley 18, likewise moves therewith which moves the barrier or arm 17 from its lower position into its upward position in which it extends transversely across one end of the parking area to block removal of the vehicle 10** from the parking area A.

As in the embodiment described above, the initial movement of the pulley 18, through appropriate switching, sets the timer in the parking meter 16 so that the time begins to run. Upon return of the occupant or driver of the vehicle parked in the parking area, he must insert sufficient coins through the slots 36 of the parking meter 16 before his vehicle can be removed from the parking area A. Upon insertion of sufficient coins through the slot 36, as in the embodiment described above, the handle 37 is permitted to rotate about the axis 38 to deactuate the timer and return the switch to its initial off position and to rotate the hammer 39 into the position shown in FIG. 4B in which the hammer 39 moves the arm 22 out of the notch 21 in the first pulley 19 so that, by reason of the weight of the arm or barrier 17, that arm or barrier 17 pivots about the pivotable axis 27 and pulls the portion of the cable 25 thereadjacent upwardly. Upon this movement, the portion of the cable 25 adjacent to and connected to the second pulley 19, moves downwardly and thereby rotates the second pulley 19 counterclockwise through substantially 180° and returns it to its initial position as shown in FIG. 3. The operator of the vehicle can then remove the vehicle from the parking area A.

Upon removal of the vehicle from the parking area A the wheels thereof move off the plate 41 and the return spring 47 pivots the two arm lever 43 in a counterclockwise direction which returns the plate 41 to its initial unactuated position against stop 46*a*. Likewise, the return spring 18*a* between the parking meter 16 and the first pulley 18 returns the first pulley 18 back to its initial position as shown in FIG. 3 whereupon the arm 22 pivotally connected at 23 to the first pulley 18 will fall back into the notches 21 in the second pulley 19 so that one complete cycle operation of this embodiment is completed and the parking system is again ready for another vehicle to park therein.

Although the elements 24 and 25 have been described above as cables, it is also contemplated in this invention that these elements may be chains or any other type of substantially inextensible line.

Likewise, it is contemplated in this invention that two next adjacent parking areas need only have single post 15 therebetween. This feature is shown in FIG. 14 in which a single post 15 has a pair of parking meters 16*a* and 16*b* mounted on the upper end thereof each of which are associated respectively with a pair of arms 17*a* and 17*b*. The arm 17*a* operates to block or not block removal of a vehicle in a parking area to the left of the post 15 as shown in FIG. 14 and the arm 17*b* functions to block or not block removal of a vehicle parked in the parking area to the right of the post 15 as shown in that figure. The other parts of the FIG. 14 parking system are substantially identical to those described above.

What is claimed is:

1. A parking system comprising:

a parking area adapted to accommodate a vehicle therein, means adjacent one end of the parking area, said means being adapted to obstruct the movement from that end of a vehicle in the parking area, a parking meter adjacent said parking area, a barrier means adjacent the other end of the parking area, said barrier means being movable between a first position in which it extends transversely of the parking area a sufficient distance to block removal of a vehicle parked therein and a second position in which the barrier means does not block removal of a vehicle in the parking area, means, actuable by a vehicle to be parked, operatively connecting said barrier means and said parking meter, said vehicle actuable means, when actuated by a vehicle, actuating said parking meter and moving the barrier means from its second position to its first position, said parking meter, upon the insertion of a sufficient monetary amount therein, being adapted to deactuate said vehicle actuable means so that said barrier means thereby moves from its first position to its second position so that a parked vehicle may be removed from the parking area, and said vehicle actuable means comprising:

an actuator member adapted to be contacted and moved by a vehicle to be parked, a first member mounted on said parking meter and connected to said actuator member, and a second member mounted on said parking meter, said second member being releasably connected to said first member, and said second member being connected to said barrier means whereby when said vehicle actuable means is initially actuated by a vehicle to be parked said actuator member is moved by the vehicle and said first member connected thereto is also moved which thereby moves said second member releasably connected thereto and said barrier means, connected to said second member, from its second to its first position and when a sufficient monetary amount is inserted in said parking meter said second member can be released from its releasable connection to said first member so that the barrier means, connected to said second member, moves from its first to its second position and a parked vehicle may be removed from the parking area.

2. A parking system as claimed in claim 1, further comprising:

a post on which said parking meter is mounted, and said barrier means comprises an elongated arm pivotally connected to said post.

3. The parking system as claimed in claim 1, wherein:

said vehicle actuable means comprises a bumper adapted to be contacted and moved by the bumper of a vehicle to be parked.

4. The parking system of claim 3, further comprising:

a substantially vertically extending post, said vehicle actuable means comprises:

a substantially vertically extending shaft rotatably mounted within said post, a member rigidly connected to an end portion of said post, a pinion rigidly mounted on said shaft, a rack adapted to mesh with said pinion, and said rack is rigidly connected to said bumper whereby when said bumper is moved by a vehicle to be parked said rack moves therewith and rotates said pinion, said shaft, and said member.

5. The parking system as claimed in claim 4, further comprising:

a return spring connected between said post and said shaft, said return spring being adapted to return said bumper to its unactuated position when a parked vehicle moves out of contact therewith.

6. The parking apparatus as claimed in claim 1, wherein:

said vehicle actuable means comprises a treadle adapted to be contacted and moved by at least one wheel of a vehicle to be parked.

7. The parking system as claimed in claim 6, wherein:

said treadle comprises a pivotable plate which extends transversely across said parking area for a distance of at least one-half the width of the parking area.

8. The parking apparatus as claimed in claim 7, wherein:

said plate is positioned in said parking area adjacent said one end thereof.

9. The parking apparatus as claimed in claim 7, wherein:

said plate lies substantially in the plane defined by the surface of the parking area and is movable between a first unactuated position and a second actuated position.

10. The parking system as claimed in claim 9, wherein:

said vehicle actuable means comprises a two-armed lever pivotable about an axis, one arm of said two-armed lever being in abutment with said plate whereby when said plate is contacted and moved by a wheel of a vehicle to be parked said plate pivots and moves from its first to its second position and moves said arm of said two-armed lever therewith.

11. A parking system as claimed in claim 1, further comprising:

a post adjacent the other end of the parking area, and said barrier means comprises an elongated arm pivotally connected to said post.

12. A parking system as claimed in claim 1, further comprising:

a shaft on said parking meter, said first member is a pulley and is mounted on said shaft, said second member is a pulley and is mounted on said shaft, and said vehicle actuable means further comprises:

a first elongated flexible substantially inextensible element, one end portion of said first element being connected to said first pulley and the other end portion of said first element being connected to said actuator member, and a second elongated flexible substantially inextensible element, one end portion of said second element being connected to said second pulley and the other end portion of said second element being connected to said barrier means.

13. A parking system as claimed in claim 12, wherein:

said first element is a cable, and said second element is a cable.

14. A parking system comprising:

a parking area adapted to accommodate a vehicle therein, means adjacent one end of the parking area, said means being adapted to obstruct the movement from that end of a vehicle in the parking area, a parking meter adjacent said parking area, a barrier means adjacent the other end of the parking area, said barrier means being movable between a first position in which it extends transversely of the parking area a sufficient distance to block removal of a vehicle parked therein and a second position in which the barrier means does not block removal of a vehicle in the parking area, means, actuable by a vehicle to be parked operatively connecting said barrier means and said parking meter, said vehicle actuable means, when actuated by a vehicle, actuating said parking meter and moving the barrier means from its second position to its first position, said parking meter, upon the insertion of a sufficient monetary amount therein, being adapted to deactuate said vehicle actuable means so that said barrier means thereby moves from its first position to its second position so that a parked vehicle may be removed from the parking area, a shaft on said parking meter, and said vehicle actuable means comprises:

a first member on said shaft, a second member on said shaft releasably connected to said first member, an actuator member adapted to be contacted and moved by a vehicle to be parked, a first element, one end portion of said first element being connected to said first member and the other end portion of said first element being connected to said actuator member, and a second element, one end portion of said second element being connected to said second member and the other end portion of said second element being connected to said barrier means whereby when said vehicle actuable means is initially actuated by a vehicle to be parked said actuator member is moved by the vehicle and said first element connected to said actuator member is also moved which thereby moves said first member, said second member releasably connected thereto, said second element and said barrier means from its second to its first position.

15. The parking system as claimed in claim 14, wherein:

said first member comprises a pulley, a return spring connected between said first pulley and said parking meter, said second member comprises a pulley, said first element comprises a cable, said second element comprises a cable, means defining a notch in the periphery of said second pulley, a spring biased arm pivotally connected to said first pulley, and said arm is releasably positionable in said notch to thereby releasably connect said first and second pulleys.

16. The parking system as claimed in claim 14, further comprising:

a post on which said parking meter is mounted, said barrier means comprises an elongated arm pivotally connected to said post, and said second element is connected to one end portion of said elongated arm.

17. The parking system as claimed in claim 14, wherein:

said actuator member comprises a bumper adapted to be contacted and moved by the bumper of a vehicle to be parked.

18. The parking system as claimed in claim 17, further comprising:

a post, said vehicle actuable means comprises:

a shaft rotatably mounted within said post, a third member rigidly connected to an end portion of said shaft, a pinion rigidly mounted on said shaft, and a rack adapted to mesh with said pinion, the other end portion of said first element is connected to said third member, and said rack is rigidly connected to said bumper whereby when said bumper is moved by a vehicle to be parked said rack moves therewith and rotates said pinion, said shaft, and said third member, and thereby moves said first element.

19. The parking system as claimed in claim 18, further comprising:

a return spring connected between said post and said shaft, said return spring being adapted to return said bumper to its unactuated position when a parked vehicle moves out of contact therewith.

20. The parking system as claimed in claim 18, wherein:

said third member comprises a pulley.

21. The parking system as claimed in claim 18, wherein:

said post and said shaft extend vertically, and an indicator member is connected to the upper end of said shaft, said indicator member being movable between a first lower position and a second upper position indicating a vehicle is properly parked.

22. The parking system as claimed in claim 21, wherein:

the upper end of said shaft is threaded, and said indicator member is substantially non-rotatable, is mounted over the upper end of said shaft, and comprises a key which extends into the threads on said shaft whereby when said bumper is moved by a vehicle to be parked said rack rotates said pinion and said shaft and said key moves upwardly along the threads in said shaft and elevates said indicator member from its first position to its second position.

23. The parking system as claimed in claim 14, wherein:

said actuator member comprises a treadle adapted to be contacted and moved by at least one wheel of a vehicle to be parked.

24. The parking system as claimed in claim 23, wherein:

said treadle comprises a pivotable plate which extends transversely across said parking area for a distance of at least one half the width of the parking area.

25. The parking system as claimed in claim 24, wherein:

said plate lies substantially in the plane defined by the surface of the parking area and is movable between a first unactuated position and a second actuated position.

26. The parking system of claim 25, wherein:

said vehicle actuable means comprises a two-armed lever pivotable about an axis, one arm of said two armed lever being connected to the other end of said first element and the other arm of said two armed lever being in abutment with said plate whereby when said plate is contacted and moved by a wheel of a vehicle to be parked said plate pivots and moves from its first to its second position and moves said other arm and said one arm of said two armed lever therewith which thereby moves said other end of said first element.

* * * * *